United States Patent [19]

Bruinette

[11] 3,983,606

[45] Oct. 5, 1976

[54] CABLE ANCHORS

[75] Inventor: Konstant E. Bruinette, Johannesburg, South Africa

[73] Assignee: Triple Bee Prestress (Proprietary) Limited, Pretoria, South Africa

[22] Filed: Sept. 30, 1974

[21] Appl. No.: 510,648

[30] Foreign Application Priority Data

Dec. 14, 1973 South Africa ..... 73/9482

[52] U.S. Cl. ..... 24/122.6

[51] Int. Cl.[2] ..... F16G 11/04

[58] Field of Search ..... 24/122.6, 115 M; 52/230, 223 L

[56] References Cited

FOREIGN PATENTS OR APPLICATIONS 1,452,219 8/1966 France ..... 52/230

775,744 5/1957 United Kingdom ..... 52/230

*Primary Examiner*—Bernard A. Gelak

*Attorney, Agent, or Firm*—Cushman, Darby & Cushman

[57] ABSTRACT

This invention is concerned with a cable anchor of the type used to anchor stressing cables included in concrete structures wherein a plurality of passages of substantially rectangular cross-section are provided through the anchor housing with their axes inclined towards each other and to lie symmetrically on the surface of an imaginary cone, each passage having a wedge associated therewith adapted to engage a cable against a convergent wall in the passage.

4 Claims, 2 Drawing Figures

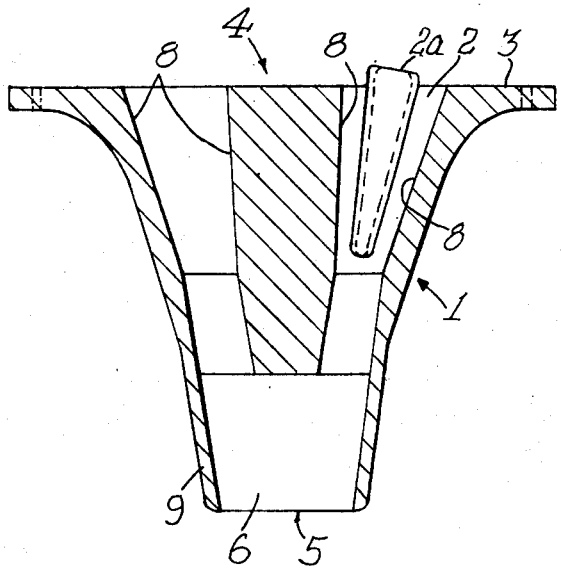
Fig 1.
Fig 2.
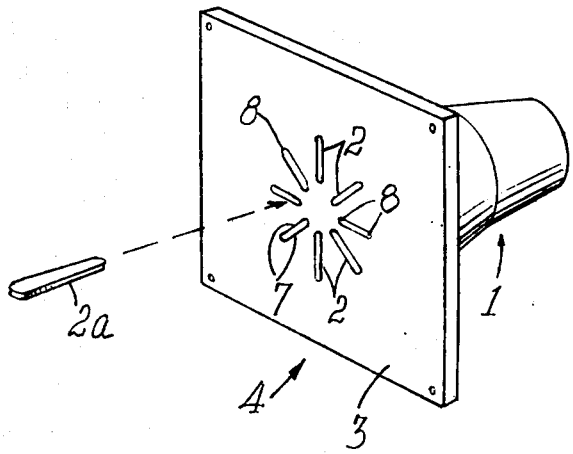

CABLE ANCHORS

This invention relates to cable anchors and more particularly to anchors of the type generally used in prestressed concrete structures to secure the ends of tensioned cables, rods or strands for example, hereinafter collectively referred to as cables.

One form of previously disclosed cable anchors of which the present applicant is aware incorporate a housing for a wedge which is basically rectangular in cross-section. The wedge and housing are adapted to engage a cable between their complementary oppositely disposed edges. The narrow end of each housing has an outwardly projecting lipped formation which enables a cable sheath to be easily attached thereto.

It will be appreciated that where a number of cables are required, an assembly of such anchors can occupy a large area and furthermore a multiplicity of protective sheaths is often necessary and these must then be connected through a junction core to a common protective sheath. Associated with the number of sheaths are undesirable friction losses between the cables and the sheaths. Furthermore when one jack is used only two or four cables can be tensioned simultaneously.

Another serious disadvantage which has been known to be encountered with this type of anchor is that there is often a sudden change of direction of at least some of the cables in the cementitious structure where the cables leave the anchor assemblies which can result in undesirable stresses being set up in the reinforcing cables.

It is thus the object of this invention to provide a cable anchor which is more suitable and can be more readily adapted for use with a large number of cables than those previously proposed.

According to this invention there is provided a cable anchor comprising a housing having a plurality of passages inclined toward each other so as to meet at one end of the housing, each passage being of basically rectangular cross-section with two opposite surfaces substantially parallel whereas the other two opposite surfaces are convergent toward each other, and a wedge associated with each passage and adapted to fit therein so that in use it will engage a cable against a convergent side thereof.

Further features of the invention provide for each wedge to engage a cable on each convergent side thereof, for the passages to be disposed in the housing so that their axes lie symmetrically on the surface of an imaginary cone, for the housing to have a flange at the end opposite the end where the passages meet, and to have a longitudinal lip at the said end where the passages meet.

Still further features of the invention provide for the housing and the wedges to be castings and for the convergent surfaces of both the wedges and the passages in the housing to conform substantially to the surface of a cable to be engaged therebetween.

The invention also provides for the included angle of the wedge and housing to be within one degree of each other.

A preferred embodiment of the invention will be described below by way of example reference being made to the accompanying drawings in which;

FIG. 1 is a cross sectional side elevation of a cable anchor;

FIG. 2 is a perspective view of the cable anchor in FIG. 1.

In this embodiment of the invention a cable anchor is designed to engage a set of 16 cables in a prestressed concrete structure. The cable anchor includes a housing 1 with passages 2 each adapted to receive a wedge **2*a*** and a pair of cables therein.

The housing 1 is generally frusto-conical in shape and has a square flange 3 at the base. The housing is conveniently made by a casting process.

A set of eight passages 2 are provided through the housing 1 each passage being adapted to receive a wedge for engaging two cables. The passages 2 initiate at the end 4 of the housing 1 having the flange and terminate at the opposite and smaller end 5 of the housing 1. The passages are inclined to each other and meet at the smaller end 5 of the housing to form a common passage 6. Also, they are preferably disposed in the housing so that their axes lie on the surface of an imaginary cone. As shown in FIG. 2 the end 4 of the housing 1 with the flange 3 will therefore have spaced openings 2 whereas the opposite or smaller end of the housing will have a single opening. The openings 2 will preferably be equally spaced on a circle concentric with the single opening at the smaller end of the housing.

Each passage 2 is basically rectangular in cross-section and has two opposite sides 7 parallel whereas the other two opposite sides 8 are inclined to each other. The inclination of the latter sides 8 is clearly apparent from FIG. 1. Further the inclined sides 8 are preferably concave to conform substantially with the surface of a cable as is apparent from FIG. 2.

Each passage 2 has a wedge **2*a* associated therewith which conforms to the shape of the passages 2.** That is, the wedge has two flat opposite and parallel sides whereas the other two opposite sides are inclined to each other. The latter sides are also preferably concave to conform to the surface of a cable to be engaged by the wedge.

A material most suitable for the anchor to be made from is spheroidal graphite. Castings of the material have the advantages of being inexpensive, provide good friction affording surfaces and can deform sufficiently to substantially complement the shape of the cables which are to be anchored. This material also enables flanges to be abutted and easily welded together where a plurality of anchors is required to meet particular applications in practice. It will be noted from FIG. 1 that the narrow single passage 6 has a larger included cone angle than the imaginary cone on which the axes of the passages lie. This has the effect of decreasing sudden changes of direction of the cables emerging from the anchor in the cementitious structure in which they are used.

In use, the flange 3 of the housing 1 is connected to shuttering shaped to form the end of a beam for example. A protective cable sheath (not shown) preferably of the flexible type, is installed over or into the smaller end 5 of the housing 1. For this purpose the smaller end 5 of the housing 1 is shaped to form an annular and longitudinal lip 9 to facilitate the installation of the cable sheath.

The beam is then cast and when set, the shuttering is removed. It will be appreciated that the housing and the guard will be embedded in the concrete beam.

Cables passed through the cable sheaths and through the respective passages 2 in the housing 1 are then tensioned and frictionally engaged and consequently secured by means of the wedges. Each passage 2 and its respective wedge engages two cables, one on each of the inclined sides 8 of the passage 2 or wedge.

It is considered that the above described cable anchor is compact, strong in use, easy to install and less expensive to manufacture than a previously proposed cable anchor assembly for use with the same number of cables. Also it will be appreciated that only one cable sheath is necessary and use of the junction cone is thereby obviated. Subsequently friction losses between the sheath and the cables will be minimised. Furthermore all 16 cables can be tensioned in one operation and by means of only one jack.

Other advantages are that all the wedges are inserted individually in the housing and in the event of one wedge not engaging a pair of cables properly, only that pair of cables needs to be retensioned.

Also the cable anchor in the above embodiment is intended to engage a maximum of 16 cables, any even number of cables less than 16 may be engaged. Other cable anchors adapted to engage more or less than 16 cables can be designed on the same principle. Anchors for 8, 12, 16 and 20 cables are considered particularly useful in practice.

What I claim as new and desire to secure by Letters Patent is:

1. A cable anchor comprising a housing having a longitudinal axis, said housing having a plurality of passages therethrough inclined toward each other so as to meet at one end of the housing, each passage being of basically rectangular cross section with two opposite surfaces substantially parallel whereas the other two opposite surfaces are convergent toward each other, at least one of said convergent surfaces of each passage being inclined toward said axis and a single wedge having a generally rectangular cross section, positioned within each passage and adapted to fit therein so that in use it will engage two cables, one cable against each convergent side thereof, the co-operating walls of the passages and associated wedges being shaped to conform to the cable to be engaged therebetween.

2. A cable anchor as claimed in claim 1 in which the axes of the passages are arranged to lie symmetrically on the surface of an imaginary cone.

3. A cable anchor as claimed in claim 2 in which the axes of the passages are arranged to lie symmetrically on imaginary contiguous conical surfaces with the surface adjaent the end of the housing where the passages meet having a larger included cone angle than the other surface.

4. A cable anchor as claimed in claim 3 in which the housing has a peripheral flange at the end where the passages are spaced apart and a circumferential outwardly extending lip around the opening from the housing where the passages meet adapted to receive a cable sheath.

* * * * *